US005269420A

United States Patent [19]

Harrison et al.

[11] Patent Number: 5,269,420

[45] Date of Patent: Dec. 14, 1993

[54] TOOTHBRUSH AND HOLDER ASSEMBLY

[75] Inventors: Susan Harrison, Wichita Falls, Tex.; Eduardo J. Rodriguez, Tiverton, R.I.

[73] Assignee: Zooth, Inc., Wichita Falls, Tex.

[21] Appl. No.: 3,463

[22] Filed: Jan. 12, 1993

[51] Int. Cl.[5] ..... A46B 17/02

[52] U.S. Cl. ..... 206/362.3; D3/66; D4/107; D4/108; 206/349; 206/457; 248/110

[58] Field of Search ..... D3/66; D4/104, 107, D4/108, 113, 116, 124–126, 138; D6/528, 534, 563, 564; D7/651, 654; D8/305; 15/167.1; 206/15.2, 15.3, 63.5, 349, 361, 362.1, 362.2–362.4, 457; 248/110, 111, 113

[56] References Cited

U.S. PATENT DOCUMENTS

| | | | |
|---|---|---|---|
| D. 40,122 | 7/1909 | Rogers . | |
| D. 127,720 | 6/1941 | Foster . | |
| D. 155,668 | 10/1949 | Zandberg et al. . | |
| D. 155,669 | 10/1949 | Zandberg et al. . | |
| D. 163,391 | 5/1951 | Jason | D6/528 |
| D. 175,198 | 7/1955 | Tasner et al. | D4/107 |
| D. 191,096 | 8/1961 | Gordon . | |
| D. 237,659 | 11/1975 | Meyer et al. . | |
| D. 252,010 | 6/1979 | Manderfield . | |
| D. 294,200 | 2/1988 | Zucker . | |
| D. 296,617 | 7/1988 | Zucker . | |
| 2,539,035 | 1/1951 | Scanlon et al. | 248/110 |
| 2,771,219 | 11/1956 | Dewey . | |
| 2,868,361 | 1/1959 | Zilem et al. | 206/362.2 |
| 3,105,612 | 10/1963 | Krasnoff et al. . | |
| 3,178,060 | 4/1965 | Bossack . | |
| 4,565,335 | 1/1986 | Rankin | 206/457 |
| 4,779,344 | 10/1988 | Panisch . | |
| 4,961,717 | 10/1990 | Hickey . | |
| 4,979,708 | 12/1990 | Aoki | 248/110 |

FOREIGN PATENT DOCUMENTS

| | | |
|---|---|---|
| 2207038 | 1/1989 | United Kingdom . |

*Primary Examiner*—Jimmy G. Foster

*Attorney, Agent, or Firm*—Wolf, Greenfield & Sacks

[57] ABSTRACT

A holder and utensil assembly for use by small children comprises a utensil having an elongated handle with a free end and an operative end. The utensil can be a toothbrush having a brush head at the operative end. The free end of the handle includes an enlarged shape that defines a sporting implement. The holder defines the shape of a human sporting figure and includes arms that extend outwardly and are sized and arranged to cradle the sporting implement shape. When the holder is mounted on a flat surface, such as a wall, the utensil can be attached to and removed from the arms typically through a narrow space provided between the hands of the arms.

17 Claims, 5 Drawing Sheets

TOOTHBRUSH AND HOLDER ASSEMBLY

FIELD OF INVENTION

This invention relates to a utensil having a unique shape and a holder for mounting the utensil therein.

BACKGROUND OF THE INVENTION

In the past, much time and effort has been expended in teaching children to properly attend to their personal hygiene. Equally large amounts of time have been spent trying to convince children to eat the food on their plate. A variety of utensils, such as toothbrushes having unique shapes, have been employed in an attempt to enhance a child's interest in using the utensils. These utensils, however, tend to become soiled when left lying on a table, sink or counter top and are often oddly shaped so that the child has difficulty using them.

It is therefore an object of this invention to provide a utensil, such as a toothbrush, having a unique shape that has an easily grippable handle and that interacts with a holder. The holder can be mounted on a wall in a position conveniently reached by a child but that maintains the utensil out of contact with a soiled surface.

SUMMARY OF INVENTION

A utensil for use by a child features a holder constructed in the shape of a human figure wearing sporting clothes and having arms sized and arranged to cradle a sporting implement. The utensil, which can be a toothbrush, includes, at a free end of the handle, remote from the operative end, a shape defining a sporting implement such as a ball or a pom pom sized to be cradled in the arms of the figure. The figure can be constructed as a unitary shape from plastic or a similar durable material and can include a flat rear surface for mounting the figure to a wall. The mounting of the holder to the wall can be accomplished by means of adhesive, double sided tape, or fasteners.

BRIEF DESCRIPTION OF THE DRAWINGS

The foregoing and other objects and advantages of the invention will become clearer with reference to the following detailed description as illustrated by the drawings in which.

DETAILED DESCRIPTION OF THE DRAWINGS

Figure 1C:
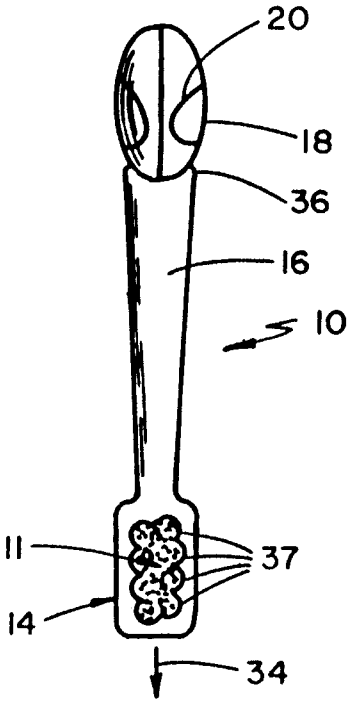
FIG. 1C is a side view of the toothbrush according to FIG. 1A.
Figure 1B:
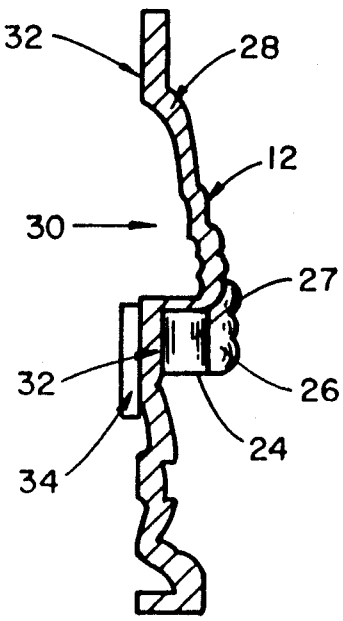
FIG. 1B is a vertical cross section of the holder taken along line I—I of FIG. 1A.
Figure 1A:
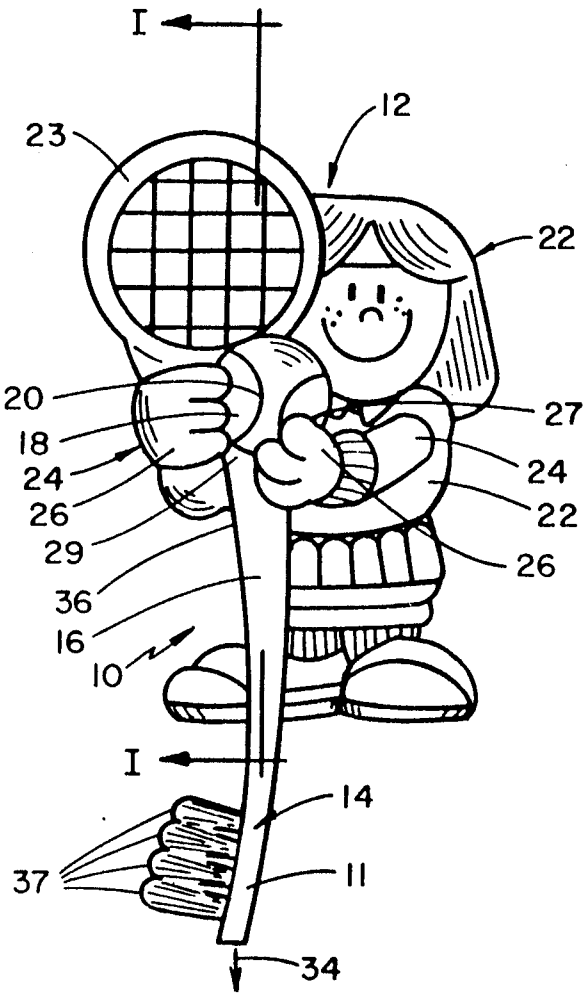
FIG. 1A is a front view of a toothbrush and holder assembly according to this invention.

A utensil, specifically a toothbrush 10, and holder 12 according to this invention are depicted in FIGS. 1A–1C. As used herein, the word "utensil" shall refer to any device adapted to be hand held and to have an operative end 14, such as a brush head, fork, spoon or knife blade located at an operative end 14 of the handle 16. For purposes of illustration, a toothbrush is shown and described, but the embodiments herein can be adapted to any type of utensil.

With reference to FIGS. 1A–1C, the toothbrush according to this embodiment includes a brush end 14 and an elongated handle 16 that is of suitable length for grasping by a small child. The length of the handle should be sized so that the brush cannot pass far enough into the child's throat to cause choking. However, the handle 16 should be long enough so that the brush head 11 can reach the rearmost teeth of the child with ease.

The handle 16 includes, at a free end 36 thereof remote from the brush head 11, a shape defining a sporting implement 18 which, in this example, is a tennis ball. By "sporting implement", it is meant any device, generally in the shape of a ball or other rounded shape, that can be held by the hands of a sportsperson. In this embodiment, the sporting implement 18 comprises a circular shape that, viewed from the front (FIG. 1A) is round and includes seaming 20 characteristic of a tennis ball. As shown in FIG. 1C, the ball 18 is somewhat flattened and ellipsoidal in its side view profile. The ellipsoidal shape serves to more effectively streamline the brush handle 16 so that it is easier to hold and easier to mount in the somewhat flattened holder 12.

In this embodiment, the holder 12 comprises a cartoon like tennis player 22 that is essentially to scale and not grotesquely misproportioned. The figure's arms 24 are outstretched and also grasp a second related sporting implement which, in this embodiment, comprises a tennis racket 23. The arms 24 and hands 26 are configured and spaced from each other so that they receive the tennis ball-shaped free end 36 of the handle 16 and prevent the handle 16 from sliding through the hands 26 of the figure 22. As such, the holder 12 can fully support the utensil 10 in suspended position. Note that the figure's arms 24 and hands 26 particularly define an open loop 27 that is smaller in inner circumference than the ball 18. The loop is open at the front with a space 29 defined between the hands 26. The space 29 is sized so that the narrower brush handle 16 can be passed through the space by lifting up on the handle 16 until the ball 18 is clear of the loop 27.

The holder 12 can be constructed as a solid figure or, as shown in FIG. 1B, as a shell 28 having a hollow back side 30. The hollow back side 30 is flattened at certain areas 32 to allow the attachment of fasteners or the application of adhesives or tape 34 (as shown) for mounting the figure 22 to a wall or other flat surface.

Thus, the figure 22 can be mounted on a wall near, for example, a bathroom sink so that the child can easily attach the brush 10 to and detach the brush 10 from the figure 22 that comprises the holder 12.

By providing a welcoming figure 22 and a toothbrush 10 having a sporting implement that compliments the figure, the child is encouraged to interact with the toothbrush and become more acquainted with it as an item of common use. The child can make a game out of placing the sporting implement into the figure's arms 24, which serves to build positive association with the toothbrush 10.

While the arms 24 of the holder 12 can be constructed to hold the toothbrush 10 in a variety of orientations, it is advantageous to orient the toothbrush head 11 downwardly (arrow 34) from the holder 12 since this orientation aids in draining water from the brush head 11. Mounting the holder 12 on a wall in an appropriate position enables rapid draining of the brush head 11, as well as isolation of the brush head 11 from the soiled surfaces of the counter.

The brush head 11 in this example is oriented with its bristles 37 to the side as shown in FIG. 1A when the brush is placed in the holder. The brush head 11 can equally be configured so that its bristles 37 are directed outwardly from or inwardly toward the front of the figure 22. Side orientation of bristles 37 achieves a flatter holder and toothbrush profile relative to the wall is desired.

Figure 2C:
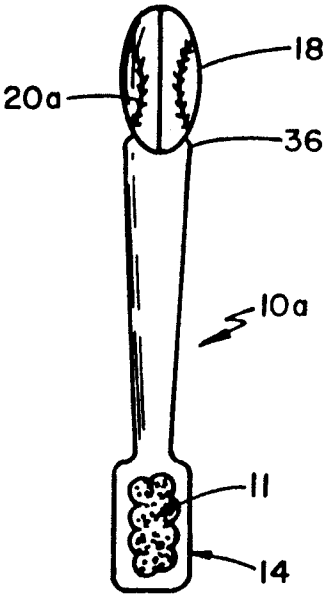
FIG. 2C is a side view of a toothbrush according to FIG. 2A.
Figure 2B:
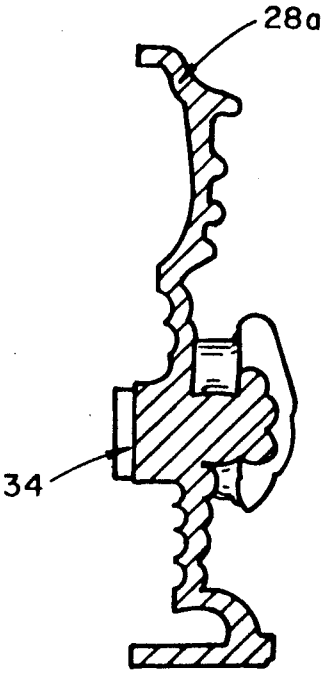
FIG. 2B is a vertical cross section of the holder taken along line II—II of FIG. 2A.
Figure 2A:
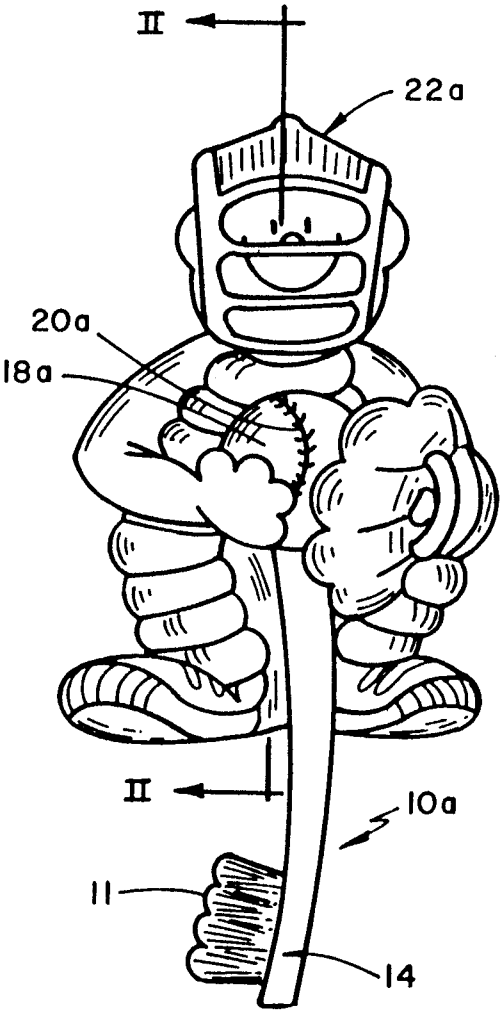
FIG. 2A is a front view of a toothbrush and holder assembly illustrating a second embodiment according to this invention.

FIGS. 2A–2C depict another embodiment for a brush and holder assembly according to this invention. The figure **22*a* retains a shell-like side profile 28*a* (FIG. 2B) with flat areas that enables it to be mounted by adhesive or tape 34 or other fasteners onto a wall. In this example, the sporting implement 18*a* on the utensil (toothbrush) 10*a* comprises a baseball having appropriate lacing 20*a* and having a somewhat flattened ellipsoidal profile 18*a* on its side (FIG. 2C**).

Figure 3C:
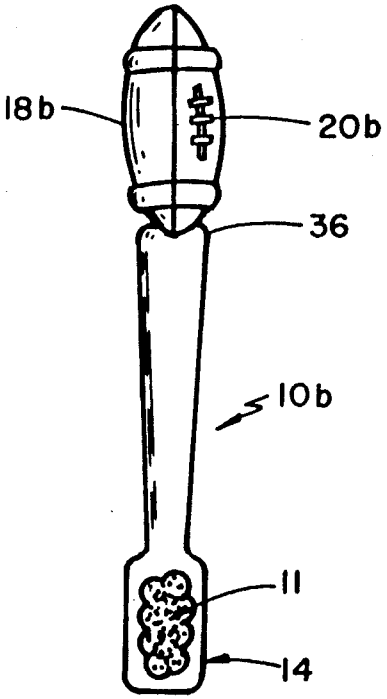
FIG. 3C is a side view of a toothbrush according to FIG. 3A.
Figure 3B:
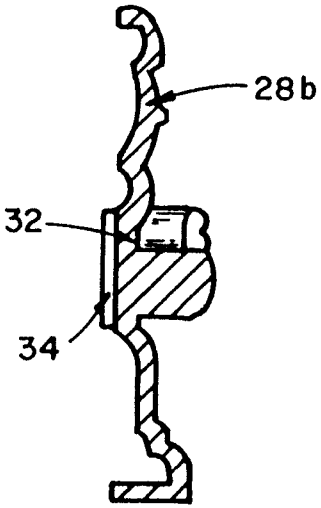
FIG. 3B is a vertical cross section of the holder taken along line III—III of FIG. 3A.
Figure 3A:
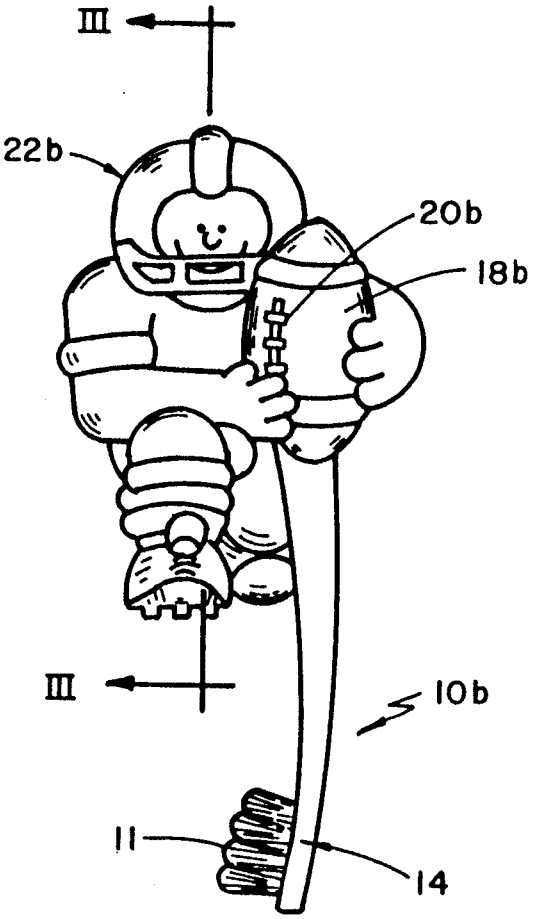
FIG. 3A is a front view of a toothbrush and holder assembly illustrating a third embodiment according to this invention.

FIGS. 3A–3C illustrate a third embodiment of the brush and holder assembly according to this invention. The sporting figure **22*b* in this embodiment is a football player again having a shell-like side profile 28*b* with a flat area 32 for applying adhesive or tape 34. The sporting implement 18*b* on the remote end 36 of toothbrush 10*b* comprises a football having appropriate lacing 20*b* and having a somewhat flattened ellipsoidal side profile (FIG. 3C). The sporting implement 18*b*** in this example is, of course, not perfectly round, but rather ellipsoidal in front view as well as side view in keeping with the outline of a football.

Figure 4C:
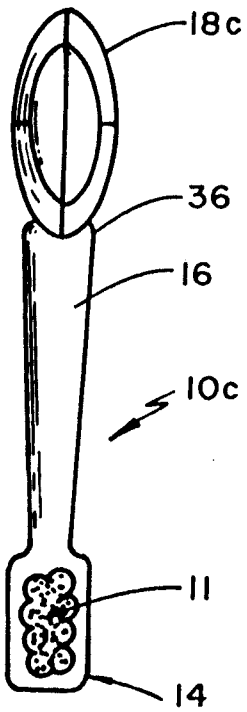
FIG. 4C is a side view of a toothbrush according to FIG. 4A.
Figure 4B:
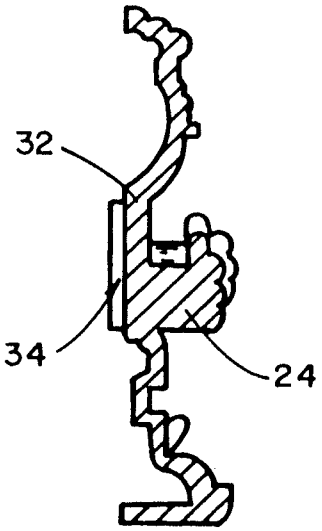
FIG. 4B is a vertical cross section of the holder taken along line IV—IV of FIG. 4A.
Figure 4A:
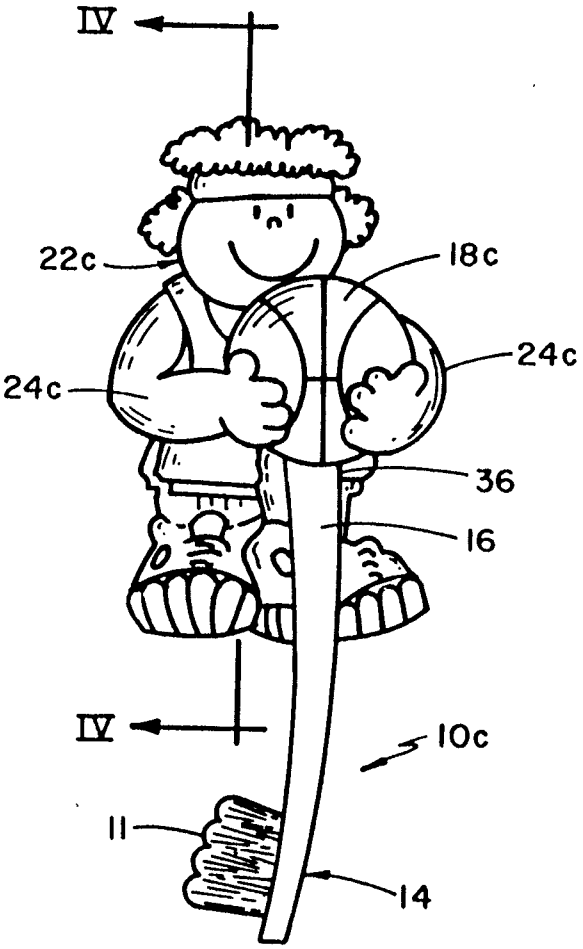
FIG. 4A is a front view of a toothbrush and holder assembly illustrating a fourth embodiment according to this invention.

A further embodiment of a toothbrush **10*c* and holder 12*c* is illustrated in FIGS. 4A–4C. The sporting figure 22*c* in this embodiment comprises a basketball player having arms 24*c* outstretched to cradle a sporting implement 18*c* in the form of a basketball on the remote end 36 of the toothbrush handle 16. In side view, this basketball player again includes a flattened area 32 to facilitate the use of adhesives 34, tape or fasteners to attach the holder to a flat surface. The sporting implement 18*c* is again flattened on its side for easy mounting in the figure's arms 24*c* (FIG. 4C**).

Figure 5:
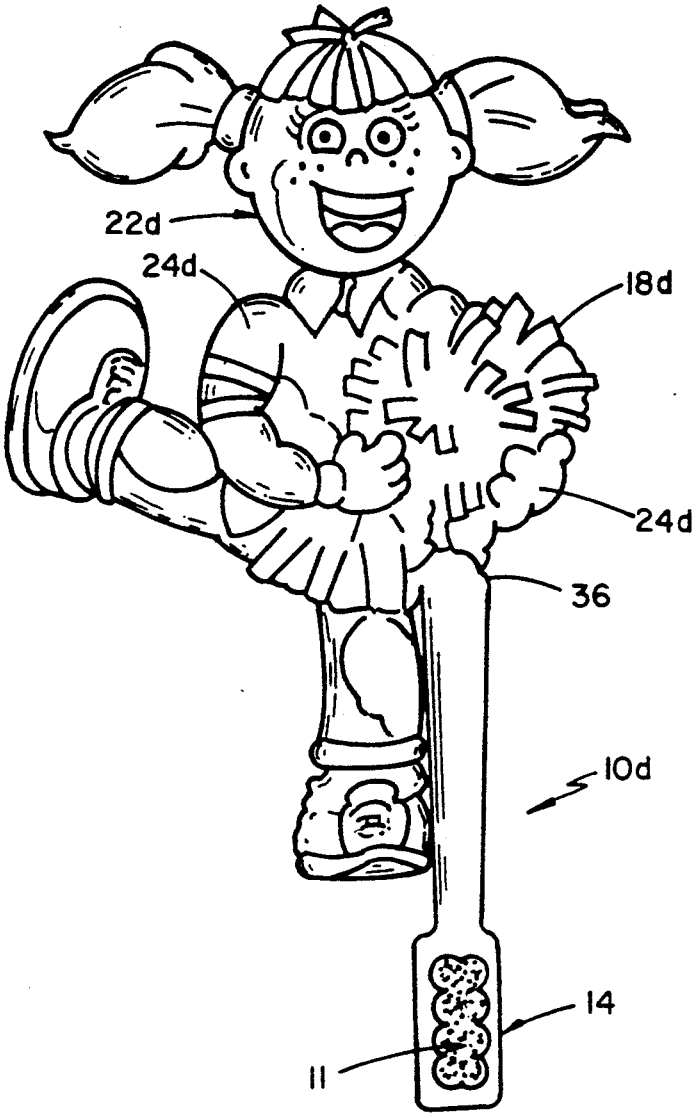
FIG. 5 is a front view of a toothbrush and holder assembly illustrating a fifth embodiment according to this invention.

The preceding embodiments relate to utensil handles having sporting implements that, in general, comprise projectiles or balls designed to be passed between players. Other sporting implements that are not representative of a projectile may also be used. FIG. 5 illustrates a cheerleader figure **22*d* having arms 24*d* outstretched to cradle a sporting implement 18*d* at the free end 36 of the toothbrush 10*d*. The sporting implement 18*d* in this example comprises a pom pom which would naturally be employed by a cheerleader. As noted above, the cheerleader figure 22*d* can comprise a solid three-dimensional shape, or can comprise a shell having a flattened back for mounting on a wall or other flat surface. Similarly, the pom-pom 18*d* can be rounded in three dimensions or can be flattened along its side into an ellipsoidal shape. Note that in this example the brush bristles 36 have been oriented outwardly away from the front of the figure 22*d***.

The preceding is a detailed description of the preferred embodiments according to this invention. Various modifications and additions can be made beyond those described herein without departing from the spirit and scope of this invention. The preceding, therefore, is meant to be taken only by way of example and not to otherwise limit the scope of the invention.

What is claimed is:

1. A holder and utensil assembly for use by small children comprising:

a utensil having an elongated handle;

an enlarged shape defining a sporting implement attached to one end of the elongated handle; and a holder defining the shape of a human figure and having outwardly extending arms, the arms sized and arranged to cradle the sporting implement so that the handle of the utensil can pass through the arms but the sporting implement cannot, and wherein the handle of the utensil extends away from the arms.

2. A holder and utensil assembly as claimed in claim 1 wherein the arms define a loop that is sized to block the implement from passing therethrough, the arms having a space therebetween sized to allow the handle to pass therethrough.

3. A holder and utensil assembly, as claimed in claim 2, wherein the holder is constructed and arranged for mounting on a wall.

4. A holder and utensil assembly, as claimed in claim 3, wherein the holder includes a flattened surface, opposite a side defining the shape of a human figure, for mounting against a wall.

5. A holder and utensil assembly, as claimed in claim 3, wherein the shape of the human figure defines a cheerleader, and the sporting implement comprises a pom-pom.

6. A holder and utensil assembly, as claimed in claim 3, wherein the human figure includes decoration corresponding to attire for a predetermined sport, and the sporting implement comprises an implement used in the predetermined sport.

7. A holder and utensil assembly, as claimed in claim 6, wherein a second implement is connected to the human figure, the second implement being an implement used in the predetermined sport.

8. A holder and utensil assembly, as claimed in claim 7, wherein the second implement is an implement that is normally utilized to engage the first implement according to the predetermined sport.

9. A holder and utensil assembly, as claimed in claim 8, wherein the shape of the human figure defines a tennis player, and the first implement comprises a tennis ball and the second implement comprises a tennis racket.

10. A holder and utensil assembly, as claimed in claim 8, wherein the shape of the human figure defines a baseball player, and the first implement comprises a baseball and the second implement comprises a baseball glove.

11. A holder and utensil assembly, as claimed in claim 3, wherein the elongated handle is substantially straight and of substantially equal width along an entire length thereof.

12. A holder and utensil assembly, as claimed in claim 11, wherein the utensil includes a toothbrush having a brush head, and wherein the sporting implement is attached to the handle at an opposite end from the brush head.

13. A holder and utensil assembly, as claimed in claim 3, wherein the elongated handle is curved and wherein the handle is narrow at one end and becomes continuously wider along the handle and is widest at an opposing end.

14. A holder and utensil assembly, as claimed in claim 13, wherein the utensil includes a toothbrush having a brush head, and wherein the sporting implement is attached to the handle at the widest end and the brush is attached to the handle at the narrowest end.

15. A holder and utensil assembly, as claimed in claim 3, wherein the sporting implement is a ball.

16. A holder and utensil assembly, as claimed in claim 15, wherein the shape of the human figure defines a football player, and the sporting implement comprises a football.

17. A holder and utensil assembly, as claimed in claim 15, wherein the shape of the human figure defines a basketball player, and the sporting implement comprises a basketball.

* * * * *